United States Patent [19]

Friswell

[11] 4,094,641

[45] June 13, 1978

[54] LOW LOSS SAMPLE BOTTLE ASSEMBLY

[75] Inventor: David R. Friswell, Holliston, Mass.

[73] Assignee: Waters Associates, Inc., Milford, Mass.

[21] Appl. No.: 772,146

[22] Filed: Feb. 25, 1977

[51] Int. Cl.[2] ..... B01L 3/00

[52] U.S. Cl. ..... 23/230 R; 23/259; 23/292; 215/12 R

[58] Field of Search ..... 23/230 R, 253 R, 292, 23/259; 215/12 R; 401/134; 73/423 A

[56] References Cited

U.S. PATENT DOCUMENTS

| | | | |
|---|---|---|---|
| 2,061,059 | 11/1936 | Carlson | 401/134 |
| 2,802,448 | 8/1957 | Young | 401/134 |
| 3,190,731 | 6/1965 | Weiskopf | 23/259 X |
| 3,449,959 | 6/1969 | Grimshaw | 23/259 UX |
| 3,680,967 | 8/1972 | Engelhardt | 73/423 A X |
| 3,836,329 | 9/1974 | Jordan | 23/259 X |
| 3,991,627 | 11/1976 | Laird et al. | 23/259 X |
| 4,012,200 | 3/1977 | Leeuw | 23/259 |

*Primary Examiner*—Morris O. Wolk
*Assistant Examiner*—Arnold Turk
*Attorney, Agent, or Firm*—Irons and Sears

[57] ABSTRACT

Low loss sample bottle assembly from which very small quantities of liquid can be removed safely, automatically and very nearly completely. The assembly comprises a spring mounted bottle having a small bottom compartment shaped to receive a needle and so sized with respect to the needle that substantially all liquid is forced from the compartment to an upper chamber and into the needle. The bottle is best equipped with a disposable, one piece, septum-like cap.

9 Claims, 4 Drawing Figures

LOW LOSS SAMPLE BOTTLE ASSEMBLY

BACKGROUND OF THE INVENTION

In organic chemistry, e.g. in biochemistry, as in a number of other fields, it is often necessary to subject to analysis very small quantitites of material. These materials are often the fruit of extensive preparatory processes which have been undertaken to isolate and identify a sample which is a minute fraction of the starting material. The amount of sample which is finally isolated is often beyond the control of the investigator. In any event, it is not rare for an investigator to have a sample prepared at great expense which is just a few microliters in volume. The storage and subsequent transfer of this material to an analytical instrument has heretofore involved excessive dilution or loss of a significant part of the sample in the vials, etc., in which it has been stored.

This problem of handling and preserving small samples has been taken into consideration in the design of analytical equipment. For example, sample injection valves and even pumps and analytical instruments have been designed to make the most efficient use of very small samples. Nevertheless, it has remained a problem for the preparative chemist to be able to supply the sample to the analyst in a way in which it may be efficiently transferred to the analytical apparatus. It has been a particular problem to achieve efficient transfer when the transfer operation is to be carried out on automatically actuated machinery.

It is these problems to which the Inventor has directed his efforts.

SUMMARY OF THE INVENTION

It is an an object of the present invention to provide a sample container in which residual samples will be as low as 3 microliters or less.

It is another object of the invention to provide a sample container achieving the objects set forth above which has the further attribute of being easily manipulated by the user.

A further object of the invention is to provide a low-loss bottle comprising a novel, economical, one piece, disposable septum.

Another object of the invention is to provide a superior process for handling and transferring very small quantities of liquid, especially with automatic liquid processing equipment.

Other objects of the invention will be obvious to those skilled in the art on their reading of this disclosure.

The above objects have been substantially achieved by providing a tapered bottle, advantageously comprising a bottom surface which is shaped to conform to a hypodermic needle or other instrument to be used in removing the sample. Such a bottle used with care can reduce the sample volume loss of a 10 microliter sample to about 2–3 microliters. Preferably the internal walls of the sample bottle will be tapered from top to bottom. It should also be furnished with some means to allow it to stand upright on a storage shelf. This can be easily achieved by molding the exterior of the bottle to a conventional flat-bottomed shape.

While use of such a bottle equipped with a septum-type cap is of substantial advantage, it does require excessive precision on the part of the operator. This is particularly so if the operation is carried out automatically, In any case, it is desirable to protect the bottle against the needle being pressed too hard or too lightly against the bottom of the bottle and yet it is necessary to assure that the bottle is snug against the needle. This problem could be solved by reversing the preferred embodiment of the invention and using the above described bottle in conjunction with a spring loaded hypodermic needle. Such an arrangement would allow the needle to be positioned and moved with a reasonable degree of care, but also would require a more complex mechanism and would require an excessively careful adjustment of the apparatus.

It has been found more advantageous to bias the bottle so that the bottle rises and falls to the extent necessary to accommodate any lack of precision in the placement and movement of the needle. In the preferred embodiment of the invention, the bottle is placed within an outer container in which a spring, positioned between the bottom and a no-loss bottle insert, allows the bottle to be moved up and down with some radial movement depending upon the strain imposed by the needle on the bottom of the inner bottle. It should be noted that any other proper biasing means, e.g. a resilient piece of polymeric foam or cushion could also serve adequately as a bottle support and/or biasing means except that such cushions tend to restrict permissable radial sway of the bottle.

ILLUSTRATIVE EXAMPLE OF THE INVENTION

In this application and accompanying drawings there is shown and described a preferred embodiment of the invention and suggested various alternatives and modifications thereof, but it is to be understood that these are not intended to be exhaustive and that other changes and modifications can be made within the scope of the invention. These suggestions herein are selected and included for purposes of illustration in order that others skilled in the art will more fully understand the invention and the principles thereof and will be able to modify it and embody it in a variety of forms, each as may be best suited in the condition of a particular case.

IN THE DRAWINGS

Figure 1:
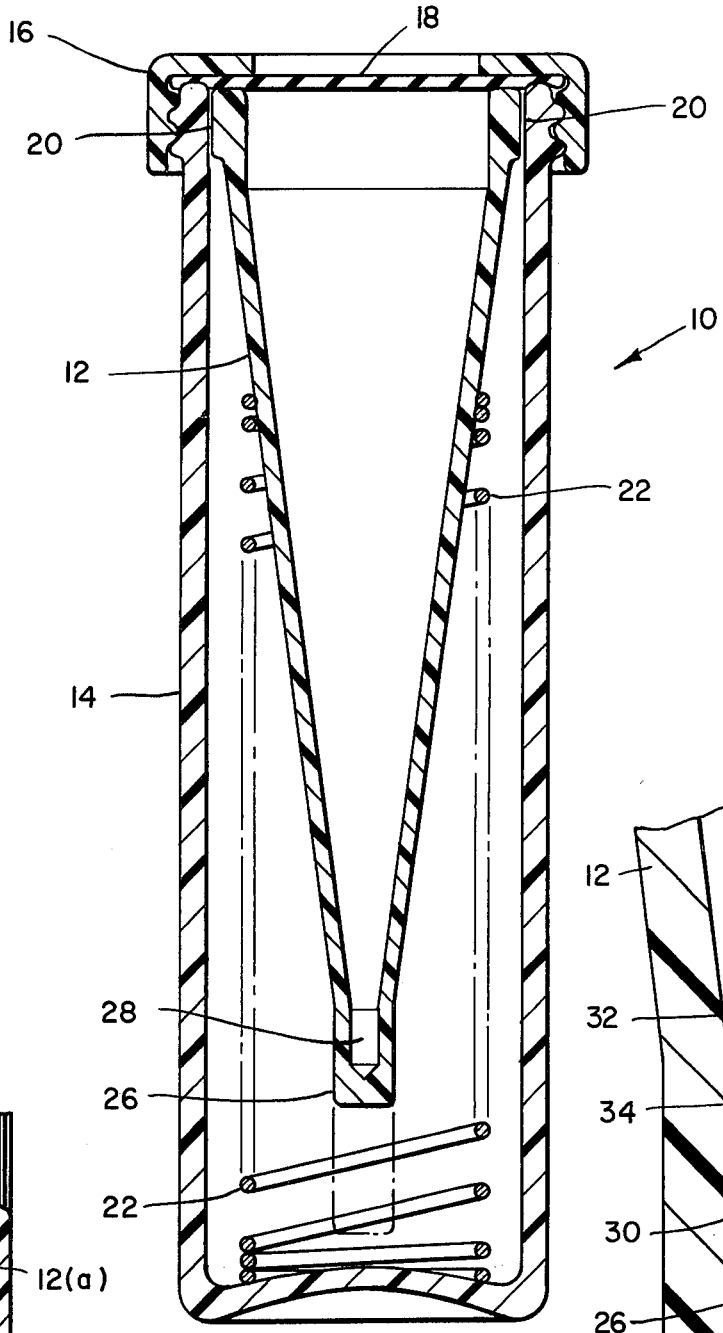
FIG. 1 is a schematic longitudinal cross-sectional view of a low-loss bottle assembly constructed according to the invention.
Figure 4:
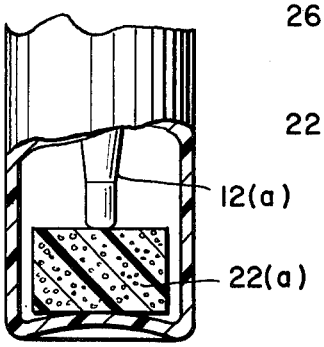

FIG. 4 is a schematic partial sectional view of another bottle structure utilizing a resilient sponge biasing means Referring to FIG. 1, it is seen that container assembly 10 comprises a sample bottle 12 mounted within an outer bottle 14 which operates as a positioning member. Bottle 14 is equipped with a septum-type cap 16 having a rubber septum 18, of the type well known in the art, mounted under the cap.

Bottle 12 is adapted to slide, up and down, at 20 within bottle 14. Spring 22 is positioned between the bottom of bottle 14 and bottle 12. It provides means for a hypodermic needle (see 24 of FIG. 2) which is thrust through septum 18, to hit the shaped bottom 26 of bottle 12 with some force and yet have the bottle cushioned against breakage.

This feature, although generally useful, is particularly important in the mechanization of the sample withdrawal step. It is absolutely essential that the needle 24 fit precisely into shaped bottom receptacle 26 of low-loss bottle 12. If it were not to reach the bottom of the bottle, the objectives of the invention would be wholly subverted by sample liquid being left in the bottom of the needle-receiving cavity 28. However, it is also impossible to allow the needle to hit the bottom of the low-loss bottle 12 with substantial force. Damage to both bottle and needle would soon result. While there are other electro-mechanical or mechanical ways for avoiding this problem, they are believed to require the use of undesirably expensive apparatus. In addition to expense, such apparatus, requires excessive maintenance and problems are often undetected until they result in a malfunction and the consequent loss of valuable sample.

Figure 2:
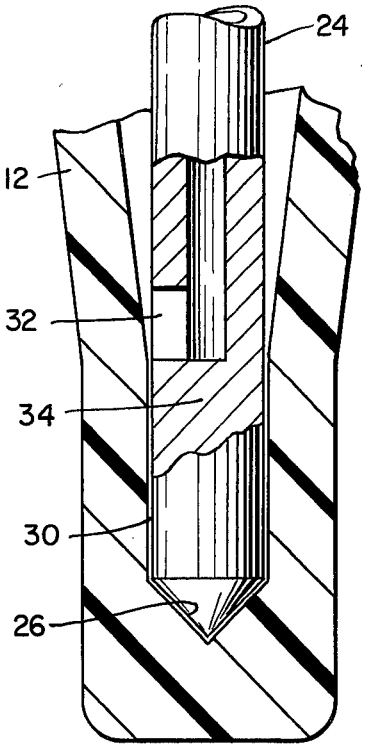
FIG. 2 is a detail partial longitudinal cross-sectional view showing co-operation of the low-loss bottle with a hypodermic needle.

As seen in FIG. 2, needle 24 (which has a bore of about 0.016 inches and an outside diameter of 0.057 inches) has a radial clearance 30 of about 0.001 inches between the wall of cavity 28 and the low-loss bottle. As the needle 24 hits the bottom of the bottle, liquid is pushed through this clearance 30 upwardly until it is sucked into port 32 of the needle 24. The portion 34 of the needle below port 32 is a solid portion serving to extrude sample liquid out of cavity 28.

In practice, it is desirable to have the cavity 28 as short as is practical. The drawings are schematic in this respect and and the depth of cavity 28 is preferably about 0.17 inch; advantageously, not more than about 0.25 inches and preferably such that the liquid within the cavity when the needle is pressed against the bottom thereof is less than about 1 microliter, preferably 0.4 microliter or lss.

It is also noted that inner bottle 12 can be easily removed from the assembly 10 because spring 22 will lift the top of bottle 12 above the top of supporting bottle 14. The spring is conveniently selected to raise the bottle about ¼ inch above the neck when the cap is removed.

It is further noted that the only functions of bottle 14 are (1) to support low-loss bottle 12 in a generally erect position and (2) to provide means to hold a cover on bottle 12. Those skilled in the art will realize that cap 16 could be placed directly on bottle 12 if that is preferred.

Figure 3:
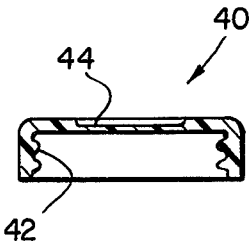
FIG. 3 is a schematic sectional view of a disposable one-piece septum cap.

FIG. 3 shows a structure similar to that shown in FIG. 1 wherein a resilient elastomeric foam biasing means 22(*a*) formed out of a resilient sponge rubber is adapted to provide the required play in the vertical position of bottle 12 (*a*).

In practice, the low-loss bottle has about a 10 to 500 microliter capacity and its biased vertical movement is from about 0.05 to 0.25 inches. A movement of 0.1 inch is adequate.

The calculated volume in the recess between the lower extruding portion of the conduit and the wall of the bottle should be less than about 1 microliter, preferably less than about 0.4 microliters. The volume of the recess itself is advantageously less than 5 microliters. A 0.015 inch radial clearance is suggested between the outer and interior bottles at the point 20 of relative sliding movement.

A disposable septum cap 40 is highly advantageous for use with the invention. It must have means 42 to affix it to the sample bottle assembly, e.g. screw threads or a snap ring. The septum means is a thin, diaphragm like central portion 44 of the cap through which the sampling conduit may penetrate. It is important that such a cap be selected from non-frangible plastic such as polypropylene, medium density polyethylene and the like. The septum itself is advantageously from 0.003 to 0.001 inch thick with an optimum thickness of 0.005 to 0.008 inch.

It is also to be understood that the following claims are intended to cover all of the generic and specific features of the invention herein described and all statements of the scope of the invention which might be said to fall therebetween.

What is claimed is:

1. A container assembly adapted to facilitate the removal of liquid contained therein into a needle having an upper hollow portion, said portion terminating at its lower end in a port, and a lower solid portion below said port, said assembly comprising:

(a) a sample bottle having a lower internal portion with a recess of smaller circumference than the circumference of the bottle internal upper portion, (b) a member surrounding and supporting said sample bottle substantially erect for vertical movement with respect to said member, (c) a resilient means positioned in said member below said sample bottle resiliently to resist downward and sideward movement of said bottle, (d) said lower portion of said sample bottle having an internal shape complementary to the external shape of a solid lower portion of a hollow needle having a port adjacent and above the solid portion, said sample bottle lower portion being capable of closely mating with a said solid lower portion of a hollow needle to displace excess liquid in said sample bottle lower portion upward, whereby the displaced liquid may be sucked into said port and said resilient means allows alignment and close mating of said needle and bottle.

2. A container assembly as claimed in claim 1, said supporting member being a bottle exterior to said sample bottle.

3. A container assembly as claimed in claim 2, said resilient means comprising a spring between said exterior bottle and said sample bottle.

4. A container assembly as claimed in claim 2, said exterior bottle having a top opening, said assembly further comprising a septum protecting said opening and through which said needle may penetrate and be withdrawn.

5. A container assembly as claimed in claim 2, said resilient means comprising the foam of an organic polymer.

6. A container assembly as claimed in claim 5, said exterior bottle having a top opening, said assembly further comprising a septum protecting said opening and through which said needle may penetrate and be withdrawn.

7. A container assembly as claimed in claim 1, said internal shape comprising a lowermost conical portion.

8. A container assembly as claimed in claim 7, said internal shape further comprising a cylindrical portion above and joined directly to said conical portion.

9. A process for the withdrawal of substantially all the liquid by a needle having a hollow tubular portion terminating in a lower port and a lower, solid portion below, adjacent to and joined to said tubular portion at said port, from a container held resiliently substantially vertical during liquid withdrawal said lower solid portiion and the lower-most portion of said container having complementarily-shaped surfaces for mating with each other, comprising the steps of:

(a) maintaining said container substantially vertical,
(b) inserting said needle into said container until the lower solid portion mates with the complementarily-shaped internal bottom surface of the container.
(c) depressing said container with said needle against resilient resistance while liquid is displaced between said complementary surfaces and is withdrawn through said port and tubular portion, and
(d) removing said needle thereby allowing said container to assume its original position.

* * * * *